US006620027B2

(12) United States Patent
Zutshi et al.

(10) Patent No.: US 6,620,027 B2
(45) Date of Patent: Sep. 16, 2003

(54) METHOD AND APPARATUS FOR HARD PAD POLISHING

(75) Inventors: Ajoy Zutshi, Fremont, CA (US); Rajeev Bajaj, Fremont, CA (US); Fred C. Redeker, Fremont, CA (US); Yutao Ma, Fremont, CA (US); Kapila Wijekoon, Palto Alto, CA (US)

(73) Assignee: Applied Materials Inc., Santa Clara, CA (US)

( * ) Notice: Subject to any disclaimer, the term of this patent is extended or adjusted under 35 U.S.C. 154(b) by 0 days.

(21) Appl. No.: 10/044,379

(22) Filed: Jan. 9, 2002

(65) Prior Publication Data

US 2002/0090886 A1 Jul. 11, 2002

Related U.S. Application Data

(60) Provisional application No. 60/260,504, filed on Jan. 9, 2001.

(51) Int. Cl.[7] ..... B24B 51/00

(52) U.S. Cl. ..... 451/5; 451/57; 451/37

(58) Field of Search ..... 451/5, 41, 57, 451/60, 36, 37, 285, 286, 287, 288, 289

(56) References Cited

U.S. PATENT DOCUMENTS

| | | | | |
|---|---|---|---|---|
| 5,152,917 | A | 10/1992 | Pieper et al. | 51/295 |
| 5,342,419 | A | 8/1994 | Hibbard | 51/308 |
| 5,368,619 | A | 11/1994 | Culler | 51/308 |

(List continued on next page.)

FOREIGN PATENT DOCUMENTS

WO WO 98/49723 11/1998 ..... H01L/21/321

OTHER PUBLICATIONS

Li, et al., High Through–Put Copper CMP With Reduced Erosion And Dishing, filed Dec. 19, 2000, USSN 09/741,538.

Li, et al., High Through–Put CU CMP With Significantly Reduced Erosion And Dishing, filed Dec. 21, 1999, USSN 09/469,709.

Li, et al., Method And Apparatus For Two–Step Barrier Layer Polishing, filed Oct. 27, 2000, USSN 09/698,864.

Emami et al., Multi–Phase Polishing Pad, filed May 2, 2002, USSN 10/139,112.

Sun et al., Method And Apparatus For Two–Step Polishing, filed Mar. 14, 2001, USSN 09/808,662.

Jin, et al., Chemical Mechanical Polishing Processes and Components. Filed Feb. 11, 2000, USSN 09/502,379.

*Primary Examiner*—Joseph J. Hail, III
*Assistant Examiner*—Hadi Shakeri
(74) *Attorney, Agent, or Firm*—Moser, Patterson & Sheridan

(57) ABSTRACT

Methods and apparatus for planarizing a substrate surface having copper containing materials thereon is provided. In one aspect, the invention provides a system for processing substrates comprising a first platen adapted for polishing a substrate with a hard polishing pad disposed on the first platen, a second platen adapted for polishing a substrate with a hard polishing pad disposed on the second platen, and a third platen adapted for polishing a substrate with a hard polishing pad disposed on the third platen. In another aspect, the invention provides a method for planarizing a substrate surface by the system described above including substantially removing bulk copper containing materials on the first platen, removing residual copper containing materials on the second platen, and then removing a barrier layer on the third platen. A computer readable program may also be provided for performing the methods described herein.

25 Claims, 3 Drawing Sheets

U.S. PATENT DOCUMENTS

| | | | | | |
|---|---|---|---|---|---|
| 5,378,251 | A | | 1/1995 | Culler et al. | 51/295 |
| 5,395,801 | A | | 3/1995 | Doan et al. | 437/225 |
| 5,514,245 | A | | 5/1996 | Doan et al. | 156/636.1 |
| 5,516,346 | A | | 5/1996 | Cadien et al. | 51/308 |
| 5,700,383 | A | | 12/1997 | Feller et al. | 216/88 |
| 5,738,574 | A | | 4/1998 | Tolles et al. | 451/288 |
| 5,897,426 | A | * | 4/1999 | Somekh | 451/41 |
| 5,913,712 | A | | 6/1999 | Molinar | 451/41 |
| 5,916,011 | A | * | 6/1999 | Kim et al. | 451/287 |
| 5,916,016 | A | * | 6/1999 | Bothra | 451/289 |
| 5,932,486 | A | | 8/1999 | Cook et al. | 438/692 |
| 5,934,980 | A | * | 8/1999 | Koos et al. | 438/692 |
| 5,951,380 | A | | 9/1999 | Kim | 451/65 |
| 6,001,730 | A | | 12/1999 | Farkas et al. | 438/627 |
| 6,062,954 | A | * | 5/2000 | Izumi | 451/285 |
| 6,068,879 | A | | 5/2000 | Pasch | 427/97 |
| 6,083,840 | A | | 7/2000 | Mravic et al. | 438/693 |
| 6,159,075 | A | * | 12/2000 | Zhang | 451/285 |
| 6,162,112 | A | * | 12/2000 | Miyazaki et al. | 451/288 |
| 6,168,508 | B1 | | 1/2001 | Nagahara et al. | 451/527 |
| 6,247,998 | B1 | | 6/2001 | Wiswesser et al. | 451/6 |
| 6,261,158 | B1 | * | 7/2001 | Holland et al. | 451/63 |
| 6,435,945 | B1 | | 8/2002 | Somekh | |

* cited by examiner

METHOD AND APPARATUS FOR HARD PAD POLISHING

CROSS-REFERENCE TO RELATED APPLICATIONS

This application claims benefit of U.S. provisional Patent Application Serial No. 60/260,504, filed Jan. 9, 2001, which is herein incorporated by reference.

BACKGROUND OF THE INVENTION

1. Field of the Invention

Embodiments of the invention generally relate to the fabrication of semiconductor devices and to chemical mechanical polishing and planarization of semiconductor devices.

2. Background of the Related Art

Reliably producing sub-half micron and smaller features is one of the key technologies for the next generation of very large scale integration (VLSI) and ultra large-scale integration (ULSI) of semiconductor devices. However, as the fringes of circuit technology are pressed, the shrinking dimensions of interconnects in VLSI and ULSI technology has placed additional demands on the processing capabilities. The multilevel interconnects that lie at the heart of this technology require precise processing of high aspect ratio features, such as vias, contacts, lines, and other interconnects. Reliable formation of these interconnects is important to VLSI and ULSI success and to the continued effort to increase circuit density and quality of individual substrates and die.

In order to further improve the current density of semiconductor devices on integrated circuits, it has become necessary to use conductive materials having low resistivity for conductors and materials having low dielectric constant (low k, defined herein as having dielectric constants, k, less than about 4.0) as insulating layers to reduce the capacitive coupling between adjacent interconnects. Increased capacitative coupling between layers can detrimentally affect the functioning of semiconductor devices.

One conductive material gaining acceptance is copper and its alloys, which have become the materials of choice for sub-quarter-micron interconnect technology because copper has a lower resistivity than aluminum, (1.7 $\mu\Omega$-cm compared to 3.1 $\mu\Omega$-cm for aluminum), a higher carrying capacity. These characteristics are important for supporting the higher current densities experienced at high levels of integration and increased device speed. Further, copper has a good thermal conductivity and is available in a highly pure state.

One difficulty in using copper in semiconductor devices is that copper is difficult to etch and achieve a precise pattern. Etching with copper using traditional deposition/etch processes for forming interconnects has been less than satisfactory. Therefore, new methods of manufacturing interconnects having copper containing materials and low k dielectric materials are being developed.

One method for forming vertical and horizontal interconnects is by a damascene or dual damascene method. In the damascene method, one or more dielectric materials, such as the low k dielectric materials, are deposited and pattern etched to form the vertical interconnects, i.e., vias, and horizontal interconnects, i.e., lines. Conductive materials, such as copper containing materials, and other materials, such as barrier layer materials used to prevent diffusion of copper containing materials into the surrounding low k dielectric, are then inlaid into the etched pattern. Any excess copper containing materials and excess barrier layer material external to the etched pattern, such as on the field of the substrate, is then removed.

As layers of materials are sequentially deposited and removed, the uppermost surface of the substrate may become non-planar across its surface and require planarization. Planarizing a surface, or "polishing" a surface, is a process where material is removed from the surface of the substrate to form a generally even, planar surface. Planarization is useful in dual damascene processes to remove excess deposited material and to provide an even surface for subsequent levels of metallization and processing. Planarization may also be used in removing undesired surface topography and surface defects, such as rough surfaces, agglomerated materials, crystal lattice damage, scratches, and contaminated layers or materials.

Chemical mechanical planarization, or chemical mechanical polishing (CMP), is a common technique used to planarize substrates. In conventional CMP techniques, a substrate carrier or polishing head is mounted on a carrier assembly and positioned in contact with a polishing pad in a CMP apparatus. The carrier assembly provides a controllable pressure to the substrate urging the substrate against the polishing pad. The pad is moved relative to the substrate by an external driving force. Thus, the CMP apparatus effects polishing or rubbing movement between the surface of the substrate and the polishing pad while dispersing a polishing composition to effect both chemical activity and mechanical activity.

Conventionally, in polishing copper features, such as a dual damascenes, the copper containing material is polished to the barrier layer, and then the barrier layer is polished to the underlying dielectric layer. However, the interface between copper and the barrier layer is generally non-planar and the copper material and the barrier materials are often removed from the substrate surface at different rates, both of which contribute to the retention of copper containing material, or residue, on the surface of the substrate during copper removal processes. To ensure removal of all the copper material and residue before removing the barrier material, it is necessary to overpolish the copper and the interface. Overpolishing of copper and the interface can result in forming topographical defects, such as concavities or depressions, referred to as dishing, and can further lead to non-uniform removal of the barrier layer disposed thereunder. Overpolishing may also result in scratching of materials on the substrate surface, such as the barrier material or a dielectric material.

FIG. 1 is a schematic view of a substrate illustrating the phenomenon of dishing. Conductive lines 11 and 12 are formed by depositing conductive materials, such as copper or copper alloy, in a feature definition formed in the dielectric layer 10, typically comprised of silicon oxides or other dielectric materials. After planarization, a portion of the conductive material is depressed by an amount D, referred to as the amount of dishing, forming a concave copper surface. Dishing results in a non-planar surface that impairs the ability to print high resolution lines during subsequent photolithographic steps and detrimentally affects subsequent surface topography of the substrate and device formation. Dishing also detrimentally affects the performance of devices by lowering the conductance and increasing the resistance of the devices, contrary to the benefit of using higher conductive materials, such as copper.

One solution to limit dishing is to remove copper material from the substrate surface in two sequential polishing steps.

For example, the first step comprises using an abrasive containing slurry on a conventional polishing pad to remove the bulk copper and then using a second abrasive containing slurry to remove the remaining copper and which may also remove a portion of the barrier layer. However, this two-step "slurry—slurry" technique can still result in an unacceptable amount of dishing. Slurry polishing has also been observed to form scratches in the surface of the substrate. The presence of scratches can detrimentally affect polishing uniformity and can detrimentally affect subsequent polishing.

Additionally, two-step copper polishing by most conventional processes require removal of the bulk copper to be performed on a first platen and the removal of the remaining copper to be performed on a second platen. The removal of the bulk copper material is a lengthy process compared to the remaining copper removal step, and the bulk copper removal becomes a limiting step that negatively effects throughput of a polishing system.

Therefore, there exists a need for apparatus and methods that facilitate the removal of copper containing material from the surface of a substrate with minimal or reduced dishing and scratching of the substrate surface.

SUMMARY OF THE INVENTION

The invention generally provides an apparatus and method for planarizing a substrate surface by the use of one or more hard polishing pads while reducing dishing and minimizing scratching of the substrate surface. In one aspect, a system is provided for processing substrates including a first platen adapted for polishing a substrate with a hard polishing pad disposed thereon, a second platen adapted for polishing a substrate with a hard polishing pad disposed on the second platen, a third platen adapted for polishing a substrate with a hard polishing pad disposed on the third platen, and a computer based controller configured to cause the system to perform a method comprising polishing the substrate with a first hard polishing pad on a first platen, polishing the substrate with a second hard polishing pad on a second platen, and then polishing the substrate with a third hard polishing pad on a third platen. The system may further comprise a carousel, at least two substrate head assemblies suspended from the carousel and capable of holding a substrate thereon, and a positioning member coupled to the carousel to move the carousel and position the substrate head assemblies over a selected polishing platen.

In another aspect, a method is provided for planarizing a substrate surface including polishing the substrate with a first hard polishing pad on a first platen to substantially remove bulk copper containing materials formed on a substrate surface, polishing the substrate with a second hard polishing pad on a second platen to remove residual copper containing materials, and then polishing the substrate with a third hard polishing pad on a third platen to remove a barrier layer formed on the substrate surface.

In another aspect, a method is provided for planarizing a substrate surface including providing a substrate comprising a dielectric layer with feature definitions formed therein, a barrier layer conformally deposited on the dielectric layer and in the feature definitions formed therein, and bulk copper containing material deposited on the barrier layer and filling the feature definitions formed therein, chemical mechanical polishing the substrate with a first hard polishing pad until the bulk copper containing material is substantially planarized, chemical mechanical polishing the substrate with a second hard polishing pad to remove residual copper containing materials formed thereon, and then chemical mechanical polishing the substrate with a third hard polishing pad to remove the barrier layer above the dielectric layer.

In another aspect, a computer readable medium is provided bearing instructions for planarizing a substrate surface, the instructions arranged such that when executed by one or more processors, cause one or more processors to control a chemical mechanical polishing system to polish the substrate with a first hard polishing pad on a first platen to substantially remove bulk copper containing materials formed on a substrate surface, polish the substrate with a second hard polishing pad on a second platen to remove residual copper containing materials, and then polish the substrate with a third hard polishing pad on a third platen to remove a barrier layer formed on the substrate surface.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

In general, aspects of the invention provide apparatus and methods for planarizing a substrate surface using one or more hard polishing pads while reducing dishing and minimizing scratching of the substrate surface. The invention will be described below in reference to a planarizing process for the removal of conductive materials, such as copper containing materials, and barrier layer materials, such as tantalum and tantalum nitride, from a substrate surface by chemical mechanical polishing (CMP) techniques with hard polishing pads.

The words and phrases used herein should be given their ordinary and customary meaning in the art by one skilled in the art unless otherwise further defined. Chemical-mechanical polishing should be broadly construed and includes, but is not limited to, abrading a substrate surface by chemical activity, mechanical activity, or a combination of both chemical and mechanical activity. A hard polishing pad is broadly described herein as a polishing pad having a polishing surface of a hardness of about 50 or greater on the Shore D Hardness scale for polymeric materials as described and measured by the American Society for Testing and Materials (ASTM), headquartered in Philadelphia, Pa.

The planarization process that can be carried out using chemical mechanical polishing process equipment, such as the Mirra® CMP System available from Applied Materials, Inc., of Santa Clara, Calif., as shown and described in U.S. Pat. No. 5,738,574, entitled, "Continuous Processing System for Chemical Mechanical Polishing," the entirety of which is incorporated herein by reference to the extent not inconsistent with the invention. Although, the CMP process and composition are illustrated utilizing the Mirra® CMP System, any system enabling polishing using the methods described herein can be used to advantage. The following apparatus description is illustrative and should not be construed or interpreted as limiting the scope of the invention.

Figure 1:
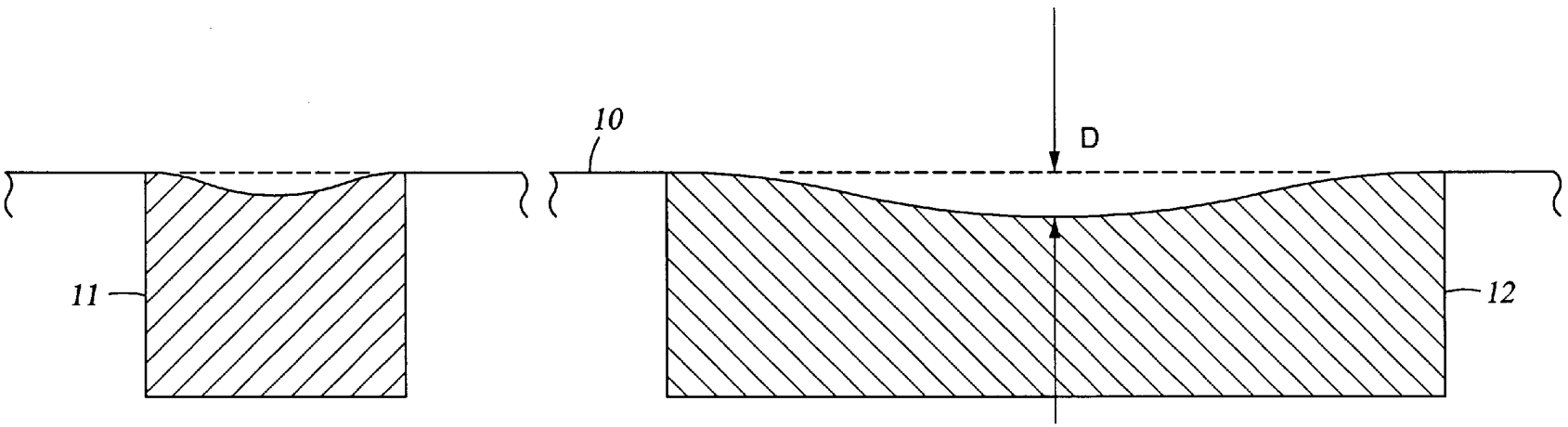
Fig. 1 (PRIOR ART)
FIG. 1 is a schematic view of a substrate illustrating the phenomenon of dishing.
Figure 2:
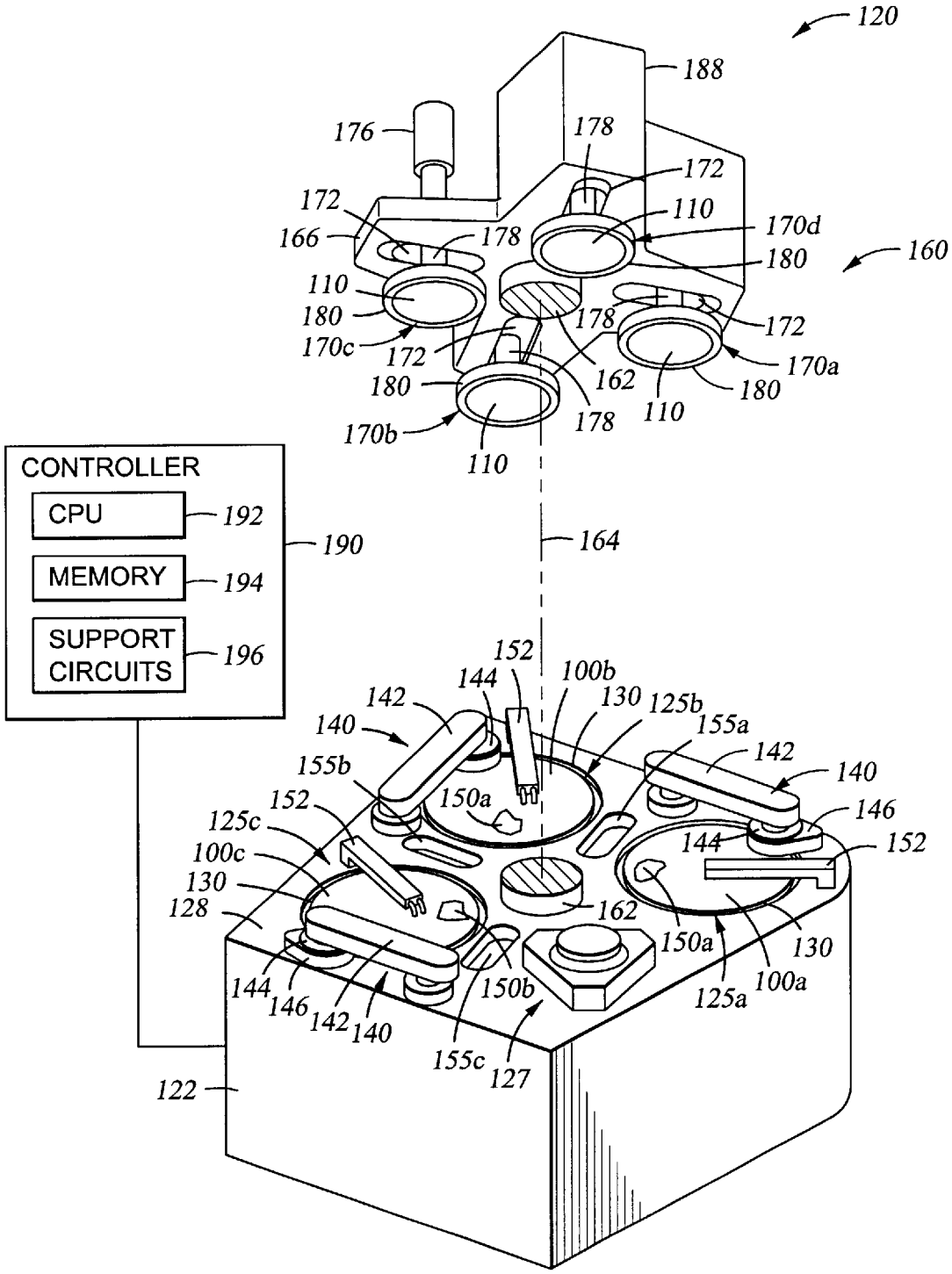
FIG. 2 is a schematic perspective view of a chemical mechanical polishing apparatus.

FIG. 2 is a schematic perspective view of a chemical mechanical polishing apparatus 120 for performing the planarizing processes and for use with the CMP compositions described herein. The polishing apparatus 120 includes a lower machine base 122 with a tabletop 128 mounted thereon and a removable outer cover (not shown). The tabletop 128 supports a series of polishing stations, including a first polishing station 125*a*, a second polishing station 125*b*, a final polishing station 125*c*, and a transfer station 127. The transfer station 127 serves multiple functions, including, for example, receiving individual substrates 110 from a loading apparatus (not shown), washing the substrates, loading the substrates into carrier heads 180, receiving the substrates 110 from the carrier heads 180, washing the substrates 110 again, and transferring the substrates 110 back to the loading apparatus.

A computer based controller 190 is connected to the polishing system or apparatus 120 for instructing the system to perform one or more processing steps on the system, such as polishing a substrate or transferring a substrate in the polishing apparatus 120. The invention may be implemented as a computer program-product for use with a computer system or computer based controller 190. The programs defining the functions of the preferred embodiment can be provided to a computer via a variety of signal-bearing media and/or computer readable media, which include but are not limited to, (i) information permanently stored on non-writable storage media (e.g. read-only memory devices within a computer such as read only CD-ROM disks readable by a CD-ROM or DVD drive; (ii) alterable information stored on a writable storage media (e.g. floppy disks within diskette drive or hard-disk drive); or (iii) information conveyed to a computer by communications medium, such as through a computer or telephone network, including wireless communication. Such signal-bearing media, when carrying computer-readable instructions that direct the functions of the invention, represent alternative embodiments of the present invention. It may also be noted that portions of the product program may be developed and implemented independently, but when combined together are embodiments of the present invention.

Each polishing station 125*a*–125*c* includes a rotatable platen 130 having a hard polishing pad 100, hard polishing pads 100*a*, 100*b*, and 100*c*, respectively. The hard polishing pad is a polishing pad having a durable roughened surface typically composed of microporous polyurethane or polyurethane mixed with a filler. The polishing pad is typically between fifty and 100 mils thick. Suitable hard polishing pads include the IC-1000, IC-1010, and the IC-1400 polishing pad available from Rodel Inc., of Phoenix Ariz. (IC-1000, IC-1010, and IC-1400 are product names of Rodel, Inc.) The hard polishing pad may include a single polishing pad material or a composite pad of one or more layers, with a surface layer having a hardness of about 50 or greater on the Shore D Hardness scale. The composite pads may have an overall hardness of less than about 50 on the Shore D Hardness scale with the polishing surface having a hardness of about 50 or greater. While the description herein describes the use of the IC series of pads from Rodel Inc., the invention is equally applicable to all polishing pad having the hardness described herein.

In one embodiment of the apparatus, the first polishing station 125*a* has a first hard polishing pad 100*a* disposed on a platen 130; and the platen 130 disposed thereon is adapted for polishing a substrate to substantially remove bulk copper-containing material disposed on the substrate. The second polishing station 125*b* has a second hard polishing pad 100*b* disposed on a platen 130; and the platen 130 disposed thereon is adapted for polishing a substrate to remove residual copper-containing material disposed on the substrate. A third polishing station 125*c* having a conventional polishing pad 100*c* may be used for a barrier removal process following the two-step copper removal process. The third polishing station 125*c* system has a third hard polishing pad 100*c* disposed on a platen 130 adapted for polishing a substrate to remove barrier layer material disposed, such as a tantalum containing material, e.g. tantalum and tantalum nitride, on the substrate.

Each platen 130 may be a rotatable aluminum or stainless steel platen connected to a platen drive motor (not shown). However, the invention contemplates that a linear polishing platen or a rotatable linear platen may be used for the first, second, and/or third polishing stations 125*a*, 125*b*, and 125*c*, if the linear polishing platen or a rotatable linear platen is capable of polishing a substrate with a hard polishing pad. An example of a linear polishing system, and an example of a polishing system having a rotatable polishing pad and a rotatable linear platen, is more fully described in co-pending U.S. patent application Ser. No. 09/244,456, filed on Feb. 4, 1999, and incorporated herein by reference to the extent not inconsistent with the invention. Alternatively, a stationary platen or a rotatable or linear platen having a stationary hard polishing pad may be used for the first, second, or third, polishing stations 125*a*, 125*b*, and 125*c*.

The invention also contemplates that an orbital polishing process or orbital polishing platen may be used for the first, second, and/or third polishing stations 125*a*, 125*b*, and 125*c*, in conjunction with a hard polishing pad. A substrate and hard polishing pad can be moved in an orbital relative motion in a linear drive system where the pad is stationary; an example of a apparatus capable of performing the orbital relative motion between the polishing pad and substrate is the Model 8200, available from Applied Materials Inc., of Santa Clara, Calif. Examples of orbital polishing platens include the Avant Guard 676, Avant Guard 776, Avant Guard 876, and Momentum polishing platforms commercially available from Speedfam IPEC Inc, of Chandler, Ariz.

The polishing stations 125*a*–125*c* may include a pad conditioner apparatus 140. The pad conditioner apparatus 140 has a rotatable arm 142 holding an independently rotating conditioner head 144 and an associated washing basin 146. The pad conditioner apparatus 140 maintains the condition of the polishing pad so that it will effectively polish the substrates. Each polishing station may include a conditioning station if the CMP apparatus is used with other pad configurations.

The polishing stations 125*a*–125*c* may each have a composition delivery/rinse arm 152 that includes two or more supply tubes to provide one or more CMP compositions, cleaning compositions, and/or water to the surface of the polishing pad. The composition delivery/rinse arm 152 delivers the one or more chemical slurries in amounts sufficient to cover and wet the entire polishing pad. Each composition delivery/rinse arm 152 also includes several spray nozzles (not shown) that can provide a high-pressure fluid rinse on to the polishing pad at the end of each polishing and conditioning cycle. Furthermore, two or more intermediate washing stations 155*a*, 155*b*, and 155*c* may be positioned between adjacent polishing stations 125*a*, 125*b*, and 125*c* to clean the substrate as it passes from one station to the next.

A rotatable multi-head carousel 160 is positioned above the lower machine base 122. The carousel 160 includes four carrier head systems 170*a*, 170*b*, 170*c*, and 170*d*. Three of the carrier head systems receive or hold the substrates 110 by pressing them against the polishing pads 100*a*, 100*b*, and 100*c*, disposed on the polishing stations 125*a*–125*c*. One of the carrier head systems 170*a*–170*d* receives a substrate from and delivers a substrate 110 to the transfer station 127. The carousel 160 is supported by a center post 162 and is rotated about a carousel axis 164 by a motor assembly (not shown) located within the machine base 122. The center post 162 also supports a carousel support plate 166 and a cover 188.

The four carrier head systems 170*a*–170*d* are mounted on the carousel support plate 166 at equal angular intervals about the carousel axis 164. The center post 162 allows the carousel motor to rotate the carousel support plate 166 and orbit the carrier head systems 170*a*–170*d* about the carousel axis 164. Each carrier head system 170*a*–170*d* includes one carrier head 180. A carrier drive shaft 178 connects a carrier head rotation motor 176 (shown by the removal of one quarter of the cover 188) to the carrier head 180 so that the carrier head 180 can independently rotate about its own axis. There is one carrier drive shaft 178 and motor 176 for each head 180. In addition, each carrier head 180 independently oscillates laterally in a radial slot 172 formed in the carousel support plate 166.

The carrier head 180 performs several mechanical functions. Generally, the carrier head 180 holds the substrate 110 against the polishing pads 100*a*, 100*b*, and 100*c*, evenly distributes a downward pressure across the back surface of the substrate 110, transfers torque from the drive shaft 178 to the substrate 110, and ensures that the substrate 110 does not slip out from beneath the carrier head 80 during polishing operations.

To facilitate control of the system as described above, the controller 190 may include a CPU 192 of FIG. 2, which CPU 192 may be one of any form of computer processors that can be used in an industrial setting for controlling various chambers and subprocessors. The memory 194 is coupled to the CPU 192. The memory 194, or computer-readable medium, may be one or more of readily available memory such as random access memory (RAM), read only memory (ROM), floppy disk, hard disk, or any other form of digital storage, local or remote. For storing information and instructions to be executed by the CPU 192.

The support circuits 196 are coupled to the CPU 192 for supporting the processor in a conventional manner. These circuits include cache, power supplies, clock circuits, input/output circuitry and subsystems, and can include input devices used with the controller 190, such as keyboards, trackballs, a mouse, and display devices, such as computer monitors, printers, and plotters. Such controllers 190 are commonly known as personal computers; however, the present invention is not limited to personal computers and can be implemented on workstations, minicomputers, mainframes, and supercomputers.

A process, for example a polishing process described below, is generally stored in the memory 194, typically as a software routine. The software routine may also be stored and/or executed by a second CPU (not shown) that is remotely located from the hardware being controlled by the CPU 192.

Although the processes described herein are discussed as being implemented as a software routine, some or all of the method steps that are disclosed therein may be performed in hardware as well as by the software controller or other means known in the art. As such, the invention may be implemented in software as executed upon a computer system, in hardware as an application specific integrated circuit or other type of hardware implementation, or a combination of software and hardware.

Chemical Mechanical Polishing Process and Composition

Generally, a method is provided for planarizing a substrate surface by polishing the substrate with a first hard polishing pad on a first platen to substantially remove bulk copper containing materials formed on a substrate surface, polishing the substrate with a second hard polishing pad on a second platen to remove residual copper containing materials, and then polishing the substrate with a third hard polishing pad on a third platen to remove a barrier layer formed on the substrate surface.

Bulk copper containing material is broadly defined herein as copper containing material deposited on the substrate in an amount sufficient to fill features formed on the substrate surface. Bulk copper containing material can include copper, copper alloys, and/or doped copper. Residual copper containing materials is broadly defined as any bulk copper containing material remaining after one or more polishing process steps have been performed on the substrate.

Residual copper containing material can include copper, copper alloys, and/or doped copper as well as by-products, such as copper oxides, of copper containing materials removed from the substrate surface. Residual copper containing material may partially or completely cover the surface a substrate, for example, a portion of the underlying barrier layer may be exposed when residual material is retained after a polishing step, or alternatively, no barrier layer may be exposed after a polishing process has been performed.

The substrate surface generally comprises a dielectric layer with feature definitions formed therein, a barrier layer deposited generally conformally on the dielectric layer, and a copper containing material deposited on the barrier layer. The copper containing material includes copper, copper alloys, or doped copper. As used throughout this disclosure, the phrase "copper containing material" and the symbol Cu are intended to encompass high purity elemental copper as well as doped copper and copper-based alloys, e.g., doped copper and copper-based alloys containing at least about 80 wt. % copper.

Suitable barrier layer material includes, but is not limited to, tantalum, tantalum nitride, and derivatives thereof, such as tantalum silicon nitride. The invention described herein also contemplates the use of other barrier materials known in the art, such as titanium, titanium nitride, tantalum derivatives, and titanium silicon nitride, titanium derivatives, and other conventional barrier materials.

The dielectric layer can comprise any of various dielectric materials conventionally employed in the manufacture of semiconductor devices. For example, dielectric materials, such as silicon dioxide, phosphorus-doped silicon glass (PSG), boron-phosphorus-doped silicon glass (BPSG), and carbon-doped silicon dioxide, can be employed. The dielectric layer can also comprise low dielectric constant materials, including fluoro-silicon glass (FSG), polymers, such as polymides, and carbon-containing silicon oxides, such as Black Diamond™, available from Applied Materials, Inc. of Santa Clara, Calif. The openings are formed in interlayer dielectrics by conventional photolithographic and etching techniques.

In one embodiment of the invention, a multi-step planarizing process for removing conductive materials and conductive material residues from a substrate surface using one or more hard polishing pads is provided. In the first step, a first polishing composition is used with a first hard polishing pad to remove bulk copper containing material form the substrate surface or to substantially planarize the bulk copper containing material. A second polishing composition is used with a second hard polishing pad to remove residual copper containing material remaining from the bulk copper containing material removal process. The residual copper containing material removal process advantageously stops on the underlying barrier layer, or is selective to the copper, thereby planarizing the surface of the substrate.

A third polishing composition is used with a third hard polishing pad to remove the barrier layer formed on the substrate surface and typically disposed above a dielectric layer. The third polishing composition is generally selective to removal of the barrier layer over removal of surrounding materials, such as the copper containing materials and the dielectric materials. The substrate may then be buffed on the third polishing pad following barrier layer removal to remove surface defects such as scratches formed on the substrate surface and in the dielectric layer. Buffing of a substrate is broadly defined herein as polishing a substrate under conditions of reduced or minimal contact pressure between the substrate and polishing pad to limit material removal. Additionally, the substrate may be transferred to a cleaning module or subjected to an in situ cleaning process to also remove surface defects, such as oxides form on the copper-containing material.

The bulk copper containing material can be selectively removed using a first polishing composition, such as an abrasive-containing polishing composition or abrasive-free polishing composition capable of removing copper containing material with minimal removal of a barrier material on a hard polishing pad. The first polishing composition may also further include abrasive particles. The first polishing composition is well suited for removing copper containing materials deposited to fill features formed on a substrate surface described above. The polishing composition may selectively remove copper-containing materials over surrounding material, such as barrier layer materials and dielectric materials. If a selective polishing composition is used, the copper-containing material may be removed over the barrier layer material at a removal rate ratio of about 10:1 or greater, such as about 100:1 or greater of copper-containing material to barrier layer material, depending upon the polishing composition used.

Examples of suitable polishing compositions, including abrasive-containing polishing compositions and abrasive-free polishing compositions, commercially available for removing copper containing material in the first polishing step on a hard polishing pad include EPC-5003, EPC-5001, and EPC-5306, available from Cabot Corp. of Aurora, Ill., Copper S1 3116, Copper S1 3280, and Copper S1 3125, available from Rodel Inc., of Newark, Del., HC-430-A1-3, HS-A3, HS-C435, and HS-A2, available from Hitachi Chemical Corp. of Japan, Microplanar CMP9000, CMP9003, and CMP9011, available from EKC Technology Inc., of Hayward Calif., Eterpol EPL 2352, EPL 2311, EPL 1405, EPL 1453, EPL 2315, EPL 2313, and Eterpol 765057, available from Eternal Chemical Company Ltd. Of Taiwan, DP-191 and DP-200, available from Dupont Chemical of Wilmington, Del.

A second polishing composition may be used with a second hard polishing pad in a second polishing step to remove residual copper containing material from the substrate. Examples of polishing compositions suitable for polishing residual copper containing material include at least one or more chelating agents. The compositions may also contain abrasive particles. The second polishing composition may selectively remove the copper-containing material over the barrier layer material at a removal rate of about 10:1 or greater, such as about 100:1 or greater, of copper-containing material to barrier layer material, depending upon the polishing composition used.

Examples of suitable polishing compositions, including abrasive-containing polishing compositions and abrasive-free polishing compositions, commercially available for removing copper containing material in the second polishing step on a hard polishing pad include EPC-5003, EPC-5001, and EPC-5306, available from Cabot Corp. of Aurora, Ill., Copper S1 3116, Copper S1 3280, and Copper S1 3125, available from Rodel Inc., of Newark, Del., HC-430-A1-3, HS-A3, HS-C435, and HS-A2, available from Hitachi Chemical Corp. of Japan, Microplanar CMP9000, CMP9003, and CMP9011, available from EKC Technology Inc., of Hayward Calif., Eterpol EPL 2352, EPL 2311, EPL 1405, EPL 1453, EPL 2315, EPL 2313, and Eterpol 765057, available from Eternal Chemical Company Ltd. Of Taiwan, DP-191 and DP-200, available from Dupont Chemical of Wilmington, Del.

It has been observed that the two-step polishing process described above with hard polishing pads reduces dishing of the copper containing material and reduces the formation of scratches on the substrate surface during chemical mechanical polishing of the substrate surface.

A third polishing composition may be used with a third hard polishing pad in a third polishing step to remove barrier layer materials, such as tantalum containing materials from the substrate. The composition may further comprise abrasive particles. The third polishing composition may selectively remove the barrier layer material over the surrounding copper-containing material and dielectric material at a removal rate of about 1:1 or greater, such as about 10:1 or greater of barrier layer to copper-containing material and dielectric material, depending upon the polishing composition used.

Examples of suitable polishing compositions, including abrasive-containing polishing compositions and abrasive-free polishing compositions, commercially available for removing barrier layer material in the third polishing step on a hard polishing pad include EPC-5220, EPC-4220, EPC-4200, and SemiSperse 12, available from Cabot Corp. of Aurora, Ill., CUS1201A, CUS1201B, available from Rodel Inc., of Newark, Del., HS-T605 and HS-T505, available from Hitachi Chemical Corp. of Japan, Cu-10K2, Cu-6.5K, and SEMICOSIL K1020, available from Planar Solutions of Adrian, Mich., Eterpol EPL 2352, EPL 1453, EPL 2315, and EPL 2313, available from Eternal Chemical Company Ltd. Of Taiwan, and Klebosol 1498-50 and Klebesol 1501-50 available from Clariant Corp. of Charlotte, N.C.

Figure 3:
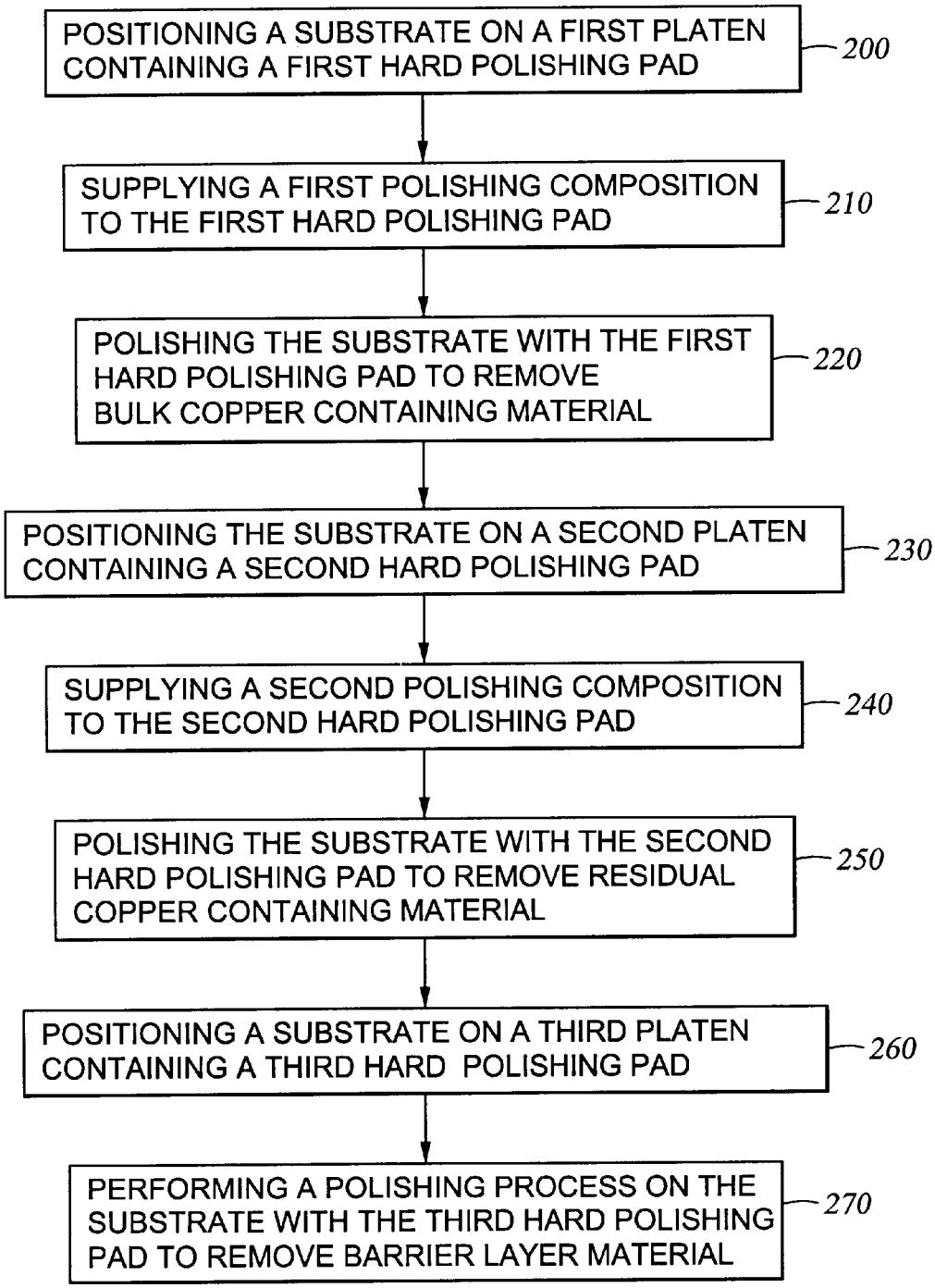
FIG. 3 is a flow chart illustrating the processing steps according to one embodiment of the invention.

FIG. 3 is a flow chart illustrating one embodiment of a process to remove copper containing materials and barrier layer materials in a three step planarization process using three hard polishing pads. A substrate is positioned on a first platen containing a first hard polishing pad at step 200, and positioning a substrate on the first hard polishing pad 100*a* disposed on platen 130 in polishing station 125*a*. A first polishing composition is supplied to the first polishing pad 100*a* at step 210. Bulk copper containing materials are then removed from the surface of the substrate by polishing the substrate at step 220.

In the polishing process, the carousel 160 positions the substrate in contact with the first polishing pad 100*a*, and the substrate and the polishing pad move relative to one another with the composition distributed therebetween to effect chemical and mechanical activity on the substrate, and then the substrate is typically removed from contact with the first polishing pad 100*a*.

The hard polishing pad is moved relative to the substrate. Relative movement is provided between the substrate and polishing pad by rotating the carrier head and platen each at a rate between about 20 rpm and about 150 rpm. In an alternative embodiment, the polishing surface is a non-rotary surface, e.g., a linear polishing system, using a sliding or circulating polishing belt or similar device. In another embodiment, the substrate and hard polishing pad are moved in an orbital relative motion. The orbital relative motion can be achieved in a linear drive system where the pad is stationary; an example of a apparatus capable of performing the orbital relative motion between the polishing pad and substrate is the Model 8200, available from Applied Materials Inc., of Santa Clara, Calif. The orbital motion between the substrate and hard polishing pad may be provided by the use of an orbital polishing platen, such platens can be found in an Avant Guard 676, Avant Guard 776, Avant Guard 876, or Momentum polishing platform, commercially available from Speedfam IPEC Inc, of Chandler, Ariz.

The first polishing composition removes substantially all of the bulk copper containing materials deposited on the substrate. The first polishing composition is delivered or supplied to the hard polishing pad at a flow rate between about 50 ml/min and about 500 ml/min from a storage medium disposed in or near the CMP apparatus. The substrate and the first hard polishing pad 100*a* are typically exposed to the first polishing composition for a period of time sufficient to remove substantially all of the bulk copper containing material disposed thereon. For example, the hard polishing pad 100*a* may be used to polish the substrate surface between about 30 seconds and about 300 seconds, but may vary depending upon the material being removed, the concentration of the components of the first polishing composition, and the amount or thickness of bulk copper containing material on the substrate.

A pressure between about 0.5 psi and about 8.0 psi, such as between about 3 psi and about 6 psi, between the substrate and the polishing pad 100 is used to provide mechanical activity to the polishing process. For polishing low k materials on a substrate surface, a polishing pressure of about 3 psi or less may be used. The copper containing material may be removed at a rate between about 4000 Å/min and about 10000 Å/min.

Bulk copper containing material not removed in the above process may remain as residual copper containing material on the substrate surface. The copper containing material and the residual copper containing materials typically comprises copper (Cu), Cu(I), Cu(II), copper oxide (CuO), and combinations thereof.

The substrate is then positioned on a second platen containing a second hard polishing pad 100*b* at step 230, and includes positioning the substrate on the second hard polishing pad 100*b* at polishing station 125*b*. A second polishing composition is supplied to the second polishing pad 100*b* at step 240. Residual copper containing materials are then removed from the surface of the substrate by polishing the substrate at step 250.

In the chemical mechanical polishing process, the carousel 160 positions the substrate in contact with the second hard polishing pad 100*b*, and the substrate and the second hard polishing pad 100*b* move relative to one another with the composition distributed therebetween to effect chemical and mechanical activity on the substrate, and then the substrate is typically removed from contact with the second polishing pad 100*b*.

The second hard polishing pad 100*b* is moved relative to the substrate. Relative movement is provided between the substrate and polishing pad by rotating the carrier head and platen each at a rate between about 20 rpm and about 150 rpm. The rotation speeds of the carrier head and the platen of the second polishing step may be less than the rotation speeds of the carrier head and the platen of the first polishing step. For example, the first polishing step may have a carrier head rotation speed of about 87 rpms and platen rotation speed of about 93 rpms and the second polishing step may have a carrier head rotation speed of about 41 rpms and platen rotation speed of about 43 rpms. In an alternative embodiment, the polishing surface is a non-rotary surface, e.g., a linear polishing system, using a sliding or circulating polishing belt or similar device.

The second CMP composition removes the residual copper containing materials described herein that may be formed thereon and is described herein. The second polishing composition is delivered or supplied to the second hard polishing pad 100*b* at a flow rate between about 50 ml/min and about 500 ml/min from a storage medium disposed in or near the CMP apparatus.

The substrate and the hard polishing pad 100*b* are typically exposed to the second polishing composition for a period of time sufficient to remove the residual copper containing materials disposed thereon and provide for over-polishing of the substrate surface to further remove defects formed thereon. For example, the hard polishing pad 100*b* may be used to polish the substrate surface between about 30 seconds and about 300 seconds, but may vary depending upon the material being removed, the concentration of the components of the second polishing composition, and the amount or thickness of copper containing materials on the substrate.

A pressure between about 0.5 psi and about 6.0 psi, such as between about 1 psi and about 2 psi, between the substrate and the second hard polishing pad 100*b* is used to provide mechanical activity to the polishing process. The polishing pressure of the second polishing step may be less than the polishing pressure of the first polishing step. For example the first polishing step may be about 6 psi and the second polishing pressure may be about 2 psi. For polishing low k materials on a substrate surface, a polishing pressure of about 1 psi or less may be used. The copper containing material is removed at a rate up to about 4000 Å/min.

The substrate is then positioned on a third platen containing a barrier removal polishing pad, or third hard polishing pad 100*c*, at step 260, and typically includes positioning a substrate on the third hard polishing pad 100*c* disposed on platen 130 in polishing station 125*c*. A barrier removal polishing composition is then supplied to the polishing pad 100*c* and barrier layer materials are then removed from the surface of the substrate by a polishing process on the substrate at step 270. The barrier removal polishing composition may be an abrasive-free composition or an abrasive containing composition. The barrier layer materials may be removed at a rate up to about 2000 Å/min.

In the barrier polishing step, the hard polishing pad 100*c* is moved relative to the substrate at a carrier head and platen rotational rate between about 20 rpm and about 150 rpm. The third polishing composition is delivered or supplied to the polishing pad 100*c* at a flow rate between about 50 ml/min and about 500 ml/min from a storage medium disposed in or near the CMP apparatus. The third hard polishing pad may be used to polish the substrate surface with the third polishing composition between about 20 seconds and about 150 seconds. A pressure between about 0.5 psi and about 6.0 psi, such as between about 2 psi and about 3 psi, between the substrate and the third hard polishing pad is used to provide mechanical activity to the polishing process. For polishing low k materials on a substrate surface, a polishing pressure of about 2 psi or less may be used.

The substrate may also be buffed on the third hard polishing pad to remove surface defects, such as scratches formed on the substrate surface. An example of a suitable buffing process and composition is disclosed in co-pending U.S. patent application Ser. No. 09/569,968, filed on May 11, 2000, and incorporated herein by reference to the extent not inconsistent with the invention.

Optionally, a cleaning solution may be applied to each of the hard polishing pads during or subsequent each of the polishing process to remove particulate matter and spent reagents from the polishing process as well as help minimize metal residue deposition on the polishing pads and defects formed on a substrate surface. An example of a suitable cleaning solution is ElectraClean™ commercially available from Applied Materials, Inc., of Santa Clara, Calif.

EXAMPLE

An example of a three-step polishing process according to aspects of the invention described herein is as follows. A substrate including a dielectric layer with feature definitions formed therein, a tantalum barrier layer conformally deposited on the dielectric layer and in the feature definitions formed therein, and a copper containing layer deposited on the barrier layer and filling the feature definitions formed therein is provided to the polishing apparatus disclosed above.

The substrate is positioned over a first hard polishing pad of a first platen, and a first polishing composition is delivered to the polishing pad. An example of a first polishing composition is the EPC-5003 polishing composition commercially available from Cabot Corp. of Aurora, Ill. The first polishing composition is delivered to the platen at about 200 ml/min. The substrate surface and the first hard polishing pad are contacted at about a polishing pressure of about 6 psi at a carrier head rotational speed of 87 rpm and a platen rotational speed of about 93 rpms. The substrate is then polished for about 70 seconds to remove bulk copper containing material at about 10000 Å/minute.

The substrate is then transferred to a second hard polishing pad on a second platen, and a second polishing composition is delivered to the polishing pad. An example of the second polishing composition is the EPC-5003 polishing composition commercially available from Cabot Corp. of Aurora, Ill. The second polishing composition is delivered to the platen at about 200 ml/min. The substrate surface and the first hard polishing pad are contacted at about a polishing pressure of about 2 psi at a carrier head rotational speed of 41 rpm and a platen rotational speed of about 43 rpms. The substrate is then polished for about 70 seconds to remove residual copper containing material at about 2500 Å/minute.

The substrate is then transferred to a third platen having a third hard polishing pad disposed thereon, and a barrier layer polishing composition is delivered to the polishing pad to remove the barrier layer material and planarize the surface of the substrate. An example of the polishing composition used on the third platen is CUS1201A or CUS1201B commercially available from Rodel Inc., of Newark, Del., delivered to the platen at about 200 ml/min. The substrate surface and the first hard polishing pad are contacted at about a polishing pressure of about 3 psi at a carrier head rotational speed of 97 rpm and a platen rotational speed of about 103 rpms. The substrate is then polished for about 50 seconds to remove bulk copper containing material at about 700 Å/minute.

The substrate may then be buffed on the third hard polishing pad and then cleaned using a suitable cleaning solution, such as ElectraClean™ commercially available from Applied Materials, Inc., of Santa Clara, Calif.

While the foregoing is directed to the one or more embodiments of the invention, other and further embodiments of the invention may be devised without departing from the basic scope thereof, and the scope thereof is determined by the claims that follow including their equivalents.

What is claimed is:

1. A system for processing a substrate, comprising:

a first platen having a first hard polishing pad having a durable roughened surface and comprising microporous polyurethane or polyurethane mixed with a filler disposed thereon, wherein the surface of the first hard polishing pad has a hardness of about 50 or greater on the Shore D Hardness scale;

a second platen having a second hard polishing pad having a durable roughened surface and comprising microporous polyurethane or polyurethane mixed with a filler disposed thereon, wherein the surface of the second hard polishing pad has a hardness of about 50 or greater on the Shore D Hardness scale;

a third platen having a third hard polishing pad having a durable roughened surface and comprising microporous polyurethane or polyurethane mixed with a filler disposed thereon, wherein the surface of the third hard polishing pad has a hardness of about 50 or greater on the Shore D Hardness scale; and a computer based controller configured to provide a plurality of instructions for planarizing a surface of the substrate, the plurality of instructions to cause the first hard polishing pad to polish the substrate, to move the substrate to the second hard polishing pad, to cause the second hard polishing pad to polish the substrate, to move the substrate to the third hard polishing pad, and to cause the third hard polishing pad to polish the substrate.

2. The system of claim 1, wherein the plurality of instructions includes instructing the first platen to polish bulk copper containing materials formed on the substrate surface.

3. The system of claim 1,wherein the plurality of instructions includes instructing the second platen to polish residual copper materials formed on the substrate surface.

4. The system of claim 1, wherein the plurality of instructions includes instructing the third platen to polish a barrier layer formed on the substrate surface.

5. The system of claim 1, further comprising:

a carousel;

at least one substrate head assembly suspended from the carousel and capable of holding a substrate thereon; and a positioning member coupled to the carousel to move the carousel and position the substrate head assemblies over a selected polishing station.

6. The system of claim 1, wherein additional instructions are further provided to cause buffing of the substrate surface by the third hard polishing pad disposed on the third platen to remove defects formed on the substrate surface.

7. The system of claim 1, additional instructions are further provided to clean the substrate surface and to remove defects formed on the substrate surface.

8. A method for planarizing a substrate surface, comprising:

polishing the substrate with a first hard polishing pad having a durable roughened surface and comprising microporous polyurethane or polyurethane mixed with a filler on a first platen to substantially remove bulk copper containing materials formed on a substrate surface, wherein the surface of the first hard polishing pad has a hardness of about 50 or greater on the Shore D Hardness scale;

polishing the substrate with a second hard polishing pad having a durable roughened surface and comprising microporous polyurethane or polyurethane mixed with a filler on a second platen to remove residual copper containing materials, wherein the surface of the second hard polishing pad has a hardness of about 50 or greater on the Shore D Hardness scale; and then polishing the substrate with a third hard polishing pad having a durable roughened surface and comprising microporous polyurethane or polyurethane mixed with a filler on a third platen to remove a barrier layer formed on the substrate surfaces wherein the surface of the third hard polishing pad has a hardness of about 50 or greater on the Shore D Hardness scale.

9. The method of claim 8, wherein the bulk copper containing materials and the residual copper containing materials comprise copper, doped copper, or copper alloys.

10. The method of claim 8, wherein the substrate surface comprises a dielectric layer with feature definitions formed therein, a barrier layer conformally deposited on the dielectric layer and in the feature definitions formed therein, wherein the bulk copper containing material is formed on the barrier layer and fills the feature definitions formed therein.

11. The method of claim 8, further comprising buffing the substrate surface to remove defects formed thereon.

12. The method of claim 11, wherein buffing the substrate surface is performed on the third hard polishing pad disposed on the third platen.

13. The method of claim 8, further comprising cleaning the substrate to remove defects formed on the substrate surface.

14. The method of claim 13, wherein the substrate surface is cleaned in a cleaning module disposed adjacent the third platen.

15. A method for planarizing a substrate surface, comprising:

providing a substrate comprising a dielectric layer with feature definitions formed therein, a barrier layer conformally deposited on the dielectric layer and in the feature definitions formed therein, and bulk copper containing material deposited on the barrier layer and filling the feature definitions formed therein;

chemical mechanical polishing the substrate with a first hard polishing pad having a durable roughened surface and comprising microporous polyurethane or polyurethane mixed with a filler until the bulk copper containing material is substantially planarized, wherein the surface of the first hard polishing pad has a hardness of about 50 or greater on the Shore D Hardness scale;

chemical mechanical polishing the substrate with a second hard polishing pad having a durable roughened surface and comprising microporous polyurethane or polyurethane mixed with a filler to remove residual copper containing materials formed thereon, wherein the surface of the second hard polishing pad has a hardness of about 50 or greater on the Shore D Hardness scale; and then chemical mechanical polishing the substrate with a third hard polishing pad having a durable roughened surface and comprising microporous polyurethane or polyurethane mixed with a filler to remove the barrier layer above the dielectric layer, wherein the surface of the third hard polishing pad has a hardness of about 50 or greater on the Shore D Hardness scale.

16. The method of claim 15, wherein the bulk copper containing materials and residual copper containing materials comprise copper, doped copper, or copper alloys.

17. The method of claim 15, wherein the barrier layer comprises a tantalum containing material.

18. The method of claim 17, wherein the tantalum containing material comprises tantalum, tantalum nitride, or derivatives thereof.

19. The method of claim 15, wherein the first hard polishing pad is located at a first platen of a polishing apparatus, the second hard polishing pad is located at a second platen of the polishing apparatus, and the third hard polishing pad is located at a third platen of the polishing apparatus.

20. The method of claim 15, further comprising buffing the substrate surface to remove defects formed thereon.

21. The method of claim 15, wherein buffing the substrate surface is performed on the third hard polishing pad disposed on the third platen.

22. The method of claim 15, further comprising cleaning the substrate in a cleaning module to remove defects formed on the substrate surface.

23. A computer readable medium bearing instructions for planarizing a substrate surface, the instructions arranged, when executed by one or more processors, to cause one or more processors to control a chemical mechanical polishing system to:

polish the substrate with a first hard polishing pad having a durable roughened surface and comprising microporous polyurethane or polyurethane mixed with a filler on a first platen to substantially remove bulk copper containing materials formed on a substrate surface, wherein the surface of the first hard polishing pad has a hardness of about 50 or greater on the Shore D Hardness scale;

polish the substrate with a second hard polishing pad having a durable roughened surface and comprising microporous polyurethane or polyurethane mixed with a filler on a second platen to remove residual copper containing materials, wherein the surface of the second hard polishing pad has a hardness of about 50 or greater on the Shore D Hardness scale; and then polish the substrate with a third hard polishing pad having a durable roughened surface and comprising microporous polyurethane or polyurethane mixed with a filler on a third platen to remove a barrier layer formed on the substrate surface, wherein the surface of the third hard polishing pad has a hardness of about 50 or greater on the Shore D Hardness scale.

24. The computer readable medium of claim 23, wherein the instructions are further arranged for buffing the substrate surface on the third platen to remove defects formed thereon.

25. The computer readable medium of claim 23, wherein the instructions are further arranged for cleaning the substrate to remove defects formed on the substrate surface.

* * * * *